US011970933B2

(12) United States Patent
Fosson

(10) Patent No.: US 11,970,933 B2
(45) Date of Patent: Apr. 30, 2024

(54) TRANSDUCER ASSEMBLY FOR OIL AND GAS WELLS

(71) Applicant: HELMERICH & PAYNE TECHNOLOGIES, LLC, Tulsa, OK (US)

(72) Inventor: Adam Robert Fosson, Jenks, OK (US)

(73) Assignee: HELMERICH & PAYNE TECHNOLOGIES, LLC, Tulsa, OK (US)

( * ) Notice: Subject to any disclaimer, the term of this patent is extended or adjusted under 35 U.S.C. 154(b) by 0 days.

(21) Appl. No.: 17/644,522

(22) Filed: Dec. 15, 2021

(65) Prior Publication Data

US 2023/0184095 A1 Jun. 15, 2023

(51) Int. Cl.

| | |
|---|---|
| ***E21B 47/10*** | (2012.01) |
| ***E21B 7/04*** | (2006.01) |
| ***E21B 21/08*** | (2006.01) |
| ***E21B 33/06*** | (2006.01) |
| ***E21B 44/00*** | (2006.01) |

(52) U.S. Cl.

CPC ..... *E21B 47/10* (2013.01); *E21B 7/04* (2013.01); *E21B 21/08* (2013.01); *E21B 33/06* (2013.01); *E21B 44/00* (2013.01)

(58) Field of Classification Search

CPC ..... E21B 21/08; E21B 33/06; E21B 47/06; E21B 47/10

See application file for complete search history.

(56) References Cited

U.S. PATENT DOCUMENTS 6,478,087 B2 * 11/2002 Allen ..... E21B 47/095 166/336
7,913,754 B2 * 3/2011 Bolding ..... E21B 33/068 166/263
7,980,305 B2 7/2011 Judge et al.
(Continued)

FOREIGN PATENT DOCUMENTS

EP 0902162 A2 3/1999
EP 3511519 A1 7/2019
(Continued)

OTHER PUBLICATIONS

PCT/US2021/072942, "International Search Report and Written Opinion", dated Aug. 4, 2022, 13 pages.

*Primary Examiner* — Jennifer H Gay
(74) *Attorney, Agent, or Firm* — Kilpatrick Townsend & Stockton LLP

(57) ABSTRACT

Systems for a transducer assembly for oil and gas wells are provided herein. The transducer assembly may include transducer block and a transducer flange. The transducer block may include a central channel having an inlet and an outlet, wherein the inlet is adapted to receive at least a portion of a fluid from a wellbore and the outlet is adapted to discharge the fluid from the central channel. The flange block may also include a port adapted to receive at least a portion of a transducer. The port may be in fluid communication with the central channel and include a channel extending from an external environment to the central channel. The transducer flange may have a central orifice that is configured to align with the port of the transducer block to create a seal between the transducer block and the transducer flange.

26 Claims, 12 Drawing Sheets

(56) References Cited

U.S. PATENT DOCUMENTS

| | | | | |
|---|---|---|---|---|
| 9,080,411 | B1 | 7/2015 | Lugo | |
| 9,217,322 | B2 * | 12/2015 | Kleppa | E21B 33/068 |
| 9,371,713 | B2 * | 6/2016 | Kleppa | E21B 47/06 |
| 10,047,599 | B2 * | 8/2018 | Maeland | E21B 47/06 |
| 10,145,236 | B2 * | 12/2018 | Vitou | E21B 47/095 |
| 10,329,860 | B2 | 6/2019 | Boutalbi et al. | |
| 10,502,021 | B2 * | 12/2019 | Healy | E21B 47/06 |
| 10,550,659 | B2 * | 2/2020 | Kibler | E21B 17/046 |
| 10,907,435 | B2 * | 2/2021 | Kibler | E21B 33/06 |
| 10,995,577 | B2 | 5/2021 | Stangherlin et al. | |
| 11,067,549 | B2 | 7/2021 | Campanella et al. | |
| 11,313,195 | B2 * | 4/2022 | Kibler | E21B 17/046 |
| 11,336,050 | B2 * | 5/2022 | James | H01R 13/5205 |
| 2002/0121369 | A1 * | 9/2002 | Allen | E21B 47/04 166/242.1 |
| 2003/0145999 | A1 * | 8/2003 | Gatherar | E21B 33/0355 166/88.4 |
| 2008/0040070 | A1 * | 2/2008 | McClanahan | E21B 33/062 702/158 |
| 2008/0196888 | A1 * | 8/2008 | Judge | E21B 33/061 251/1.3 |
| 2009/0000781 | A1 * | 1/2009 | Bolding | E21B 33/068 166/263 |
| 2013/0027215 | A1 * | 1/2013 | Kleppa | E21B 34/02 340/853.2 |
| 2014/0166264 | A1 * | 6/2014 | Judge | E21B 33/063 166/66 |
| 2014/0216715 | A1 * | 8/2014 | Kleppa | E21B 47/06 166/66 |
| 2014/0216757 | A1 * | 8/2014 | Kleppa | E21B 34/02 166/377 |
| 2015/0123022 | A1 * | 5/2015 | Meraz | E21B 33/063 251/1.1 |
| 2017/0044861 | A1 * | 2/2017 | Guedes | E21B 19/00 |
| 2017/0074067 | A1 * | 3/2017 | Jaffrey | F16K 37/0083 |
| 2017/0089163 | A1 * | 3/2017 | Vitou | E21B 47/095 |
| 2018/0073320 | A1 * | 3/2018 | Holmes | G05B 9/03 |
| 2019/0234173 | A1 * | 8/2019 | Bennett | E21B 44/00 |
| 2019/0301249 | A1 * | 10/2019 | Kibler | E21B 17/046 |
| 2020/0072010 | A1 * | 3/2020 | Kibler | F16L 37/62 |
| 2021/0102436 | A1 * | 4/2021 | Kibler | F16L 37/62 |
| 2021/0246753 | A1 * | 8/2021 | Kibler | F16L 37/002 |
| 2022/0228462 | A1 * | 7/2022 | Guidry | E21B 34/02 |
| 2022/0282587 | A1 * | 9/2022 | Ducamin | E21B 34/16 |

FOREIGN PATENT DOCUMENTS

| | | | | |
|---|---|---|---|---|
| WO | WO-9115740 | A1 * | 10/1991 | G01L 9/00 |
| WO | WO-2008101005 | A1 * | 8/2008 | E21B 33/061 |
| WO | WO-2013056858 | A1 * | 4/2013 | E21B 33/0355 |
| WO | WO-2022246236 | A1 * | 11/2022 | |

* cited by examiner

DRILLING ARCHITECTURE

TRANSDUCER ASSEMBLY FOR OIL AND GAS WELLS

TECHNICAL FIELD

This application is directed to methods and systems for installing and using a transducer assembly at a well, such as oil or gas wells, and more particularly to a transducer assembly, such as a pressure transducer assembly, for a blowout preventer at such wells. The transducer assembly provided herein may be provided as part of a blowout preventer for improved safety during drilling operations.

BACKGROUND

Drilling a borehole for the extraction of minerals has become an increasingly complicated operation due to the increased depth and complexity of many boreholes, including the complexity added by directional drilling. The added complexity of boreholes has also increased the safety risk during drilling operations. During drilling, a wellbore may encounter a formation pressure that is substantially higher than the pressure maintained in the wellbore. The pressure differential between the formation pressure and the wellbore pressure can cause a "blowout" of a formation and drilling fluids at the surface of the wellbore. Blowouts are dangerous and can cause catastrophic damage to drilling equipment, injury, and even loss of life of rig personal.

To mitigate the risk of a blowout, blowout preventers are often installed at the surface of the wellbore. A blowout preventer is designed to cut off the flow of fluids from the wellbore to prevent a blowout. Well data may be monitored to determine when to engage a blowout preventer. For example, pressure of the fluid from the wellbore may be monitored for dramatic changes, which can indicate an imminent blowout. When a dramatic change in pressure is determined, the blowout preventer may be engaged to prevent fluid from the wellbore from breaching the surface.

Due to the extreme conditions of the wellbore line, a choke manifold is typically installed after the blowout preventer. The choke manifold is used to lower the pressure from the wellhead, before the wellbore fluid is sent for downstream processing. Line measurements are typically taken at the choke manifold due to the extreme conditions of the wellbore fluid. For example, fluid pressure is typically measured at the choke manifold. As used herein, a line measurement refers to a measurement taken of a fluid, such as the fluid in a wellbore, to determine one or more conditions of the fluid, such as pressure, temperature, or flowrate of the fluid.

Taking line measurements at the choke manifold, however, can lead to incorrect readings, and ultimately dangerous situations such as a blowout. Thus, the pressure reading at the choke manifold is important. During the Pryor Trust Well incident, workers checked the line pressure at the choke inlet and received an error reading of zero pressure. Partly, because the line pressure was read downstream of the blowout preventer, the pressure reading did not accurately reflect the pressure at the blowout preventer. Thus, the crew did not engage the blowout preventer which could have prevented a blowout and the resulting loss of life. Accordingly, there is a need for an improved means of taking line measurements at the blowout preventer.

SUMMARY

Systems and methods of implementation for a transducer assembly for oil and gas wells are provided herein. According to one aspect, a blowout preventer is provided. The blowout preventer may include a body having a channel that is configured to receive fluid from a wellbore. The blowout preventer may also include one or more rams that are configured to block fluid flow through the channel when in a first position but allow fluid flow through the channel when in a second position.

The blowout preventer may also include a transducer assembly. The transducer assembly may include transducer block and a transducer flange. The transducer block may include a central channel having an inlet and an outlet, wherein the inlet is adapted to receive at least a portion of a fluid from a wellbore and the outlet is adapted to discharge the fluid from the central channel. The flange block may also include a port adapted to receive at least a portion of a transducer. For example, the transducer may be a pressure transducer or a flow rate transducer. The port may be in fluid communication with the central channel and include a channel extending from an external environment to the central channel. In some embodiments, the port is perpendicular to the central channel of the transducer block. The transducer flange may have a central orifice that is configured to align with the port of the transducer block to create a seal between the transducer block and the transducer flange. In some embodiments, the transducer flange may include a seat.

In some embodiments, the blowout preventer may further include a drilling pipe. In such cases, at least a portion of the fluid flow through the channel flows through the drilling pipe and the transducer assembly is positioned to receive the portion of fluid flow from the drilling pipe. According to some embodiments, the blowout preventer may also include a transducer. The transducer may be inserted into the port of the transducer block and be positioned so that at least a portion of the transducer is positioned within the central channel of the transducer blow. In other embodiments, the transducer may be inserted into the port of the transducer block and positioned so that a sensor-end of the transducer is positioned within the port of the transducer block.

In another aspect, a transducer assembly is provided. The transducer assembly may include transducer block and a transducer flange. The transducer block may include a central channel having an inlet and an outlet, wherein the inlet is adapted to receive at least a portion of a fluid from a wellbore and the outlet is adapted to discharge the fluid from the central channel. The flange block may also include a port adapted to receive at least a portion of a transducer. For example, the transducer may be a pressure transducer or a flow rate transducer. The port may be in fluid communication with the central channel and include a channel extending from an external environment to the central channel. In some embodiments, the port may be perpendicular to the central channel. The transducer flange may have a central orifice that is configured to align with the port of the transducer block to create a seal between the transducer block and the transducer flange. For example, the transducer block may include a seat for the transducer. In such examples, the transducer assembly may include a pressure transducer that is positioned in the seat of the transducer block so that a first portion of the pressure transducer is inserted into the port of the transducer block. The transducer flange may be positioned to receive a second portion of the pressure transducer through the central orifice and the transducer flange may be bolted to the transducer block to form the seal between the transducer block and the transducer flange.

In some embodiments, the transducer assembly may include a pressure transducer inserted through the central orifice of the transducer flange and into the port of the transducer block. Optionally, the transducer assembly may include a neck around an external surface of the central orifice to provide support to the pressure transducer. In some cases, the transducer block and the transducer flange may be configured to blot together to form the transducer assembly. In some embodiments, the inlet of the transducer assembly may further include a flange positioned to connect the inlet of the central channel to a drilling pipe so as to receive the fluid from the wellbore. Optionally, the transducer assembly may be adapted to be coupled to a blowout preventer.

In one aspect, a method of determining a condition during drilling of a well is provided. The method of determining a condition during drilling of a well may include providing a transducer for taking a measurement of fluid from a well being drilled, wherein the transducer is coupled to a computer system. For example, the transducer may be a pressure transducer and the plurality of measurements received by the computer system may be a plurality of pressure measurements. The method may also include providing a transducer assembly. The transducer assembly may include a transducer block and a transducer flange. The transducer block includes a central channel having an inlet and an outlet, wherein the inlet is adapted to receive at least a portion of the fluid from the well and the outlet is adapted to discharge the fluid from the central channel. The transducer block may also include a port adapted to receive at least a portion of the transducer. The port may be in fluid communication with the central channel and include a channel extending from an external environment to the central channel. The transducer flange may have a central orifice that is configured to align with the port of the transducer block to create a seal between the transducer block and the transducer flange.

The method may also include receiving, by the computer system, a plurality of measurements from the transducer and determining, by the computer system, responsive to the measurements, if a condition exists. In some embodiments, the condition may be predictive of an event. For example, the condition may be an influx of hydrocarbons into the well and the event may be a blowout.

In some embodiments, the transducer assembly may be provided as part of a blowout preventer. The blowout preventer may include a body having a channel that is configured to receive fluid from the wellbore and one or more rams that are configured to block fluid flow through the channel when in a first position but allow fluid flow through the channel when in a second position. In such embodiments, the transducer assembly may receive at least a portion of the fluid from the wellbore. The method may further include generating, by the computer system, an alert when one of the plurality of measurements is above a threshold. Optionally, when one of the plurality of measurements is above a threshold, the method may include determining, in response to the alert, a corrective action to be taken, and taking the corrective action. In some embodiments, the corrective action may include engaging the one or more rams of the blowout preventer to prevent fluid flow through the channel. In other embodiments, the corrective action may include modifying one or more drilling parameters of the wellbore being drilled. For example, the corrective action may include at least one of: increasing drilling mud pressure, increasing density of the drilling mud, reducing weight-on-bit (WOB) of drill string used to drill the well, reducing rotations-per-minute (RPMs) of the drill string, reducing rate-of-penetration (ROP) of the drill string, increasing measurement rate, and determining rate of change between consecutive measurements.

In another aspect of the disclosure, a computer software program may be provided, wherein the computer software program may comprise instructions in source code or in executable or interpretable form (or a combination of forms) for performing the steps described above with respect to a method of determining a condition during drilling of a well, and may exist as one or more files that may be stored on any type of computer readable media, including a CD, a DVD, a jump or pen drive, a USB drive, in volatile or non-volatile memory, or may be embedded in whole or in part on a semiconductor device.

In another aspect, a non-transitory computer-readable medium is provided. The non-transitory computer-readable medium may include instructions executable by the processor for performing one or more of the above described steps with respect to the method of determining a condition during drilling of a well. Implementations of the described techniques and methods may include hardware or configurations as suitable for use in drilling systems and as described throughout this disclosure.

BRIEF DESCRIPTION OF THE DRAWINGS

For a more complete understanding, reference is now made to the following description taken in conjunction with the accompanying drawings in which.

DETAILED DESCRIPTION

Figure 1:
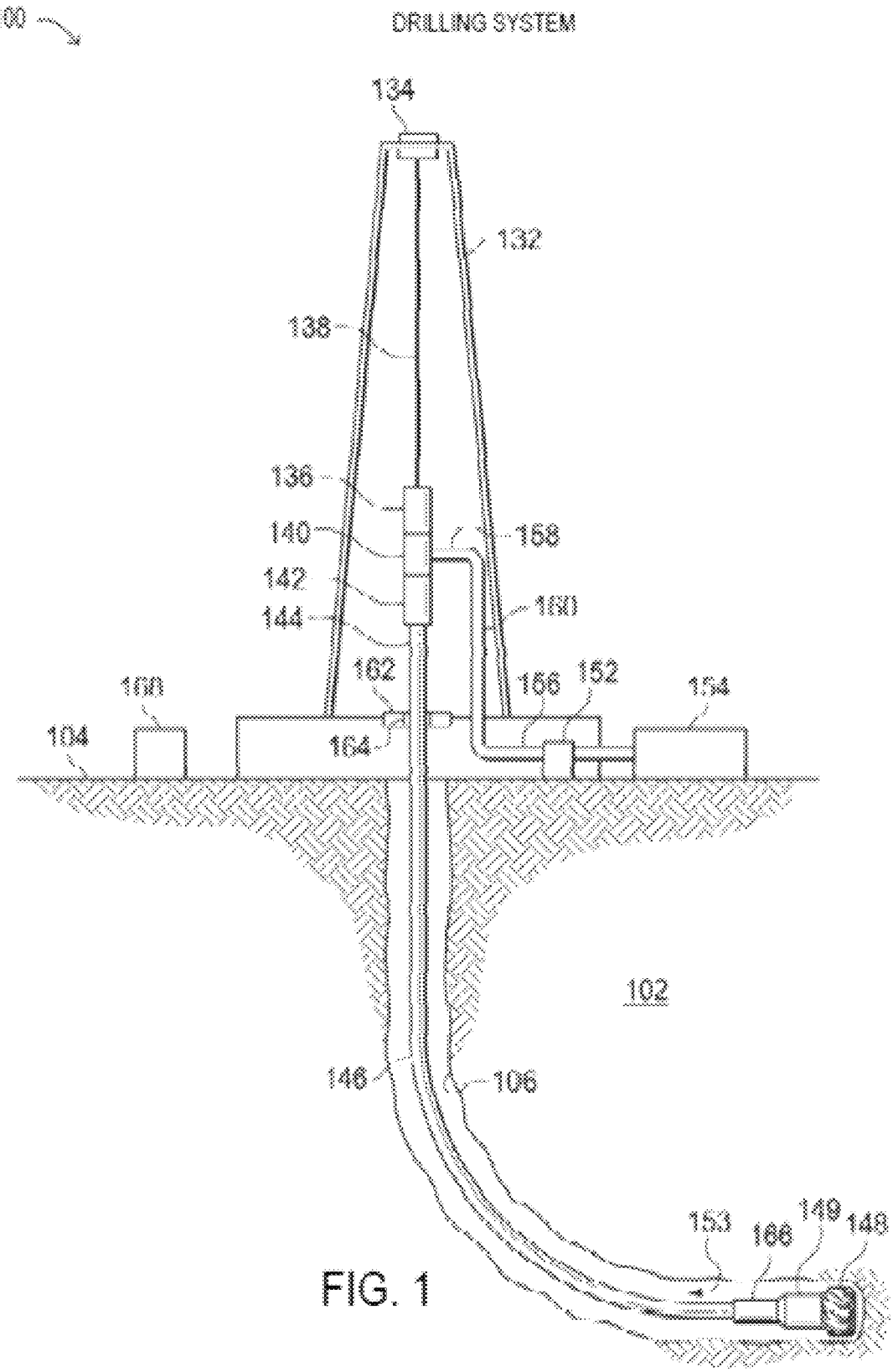
FIG. 1 is a depiction of a drilling system for drilling a borehole.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Referring now to the drawings, wherein like reference numbers are used herein to designate like elements throughout, the various views and embodiments of a transducer assembly and method for determining an a condition using the transducer assembly are illustrated and described, and other possible embodiments are described. The figures are not necessarily drawn to scale, and in some instances the drawings have been exaggerated and/or simplified in places for illustrative purposes only. Many possible applications and variations may be based on the following examples of possible embodiments.

Drilling a well typically involves a substantial amount of human decision-making during the drilling process. For example, geologists and drilling engineers use their knowledge, experience, and the available information to make decisions on how to plan the drilling operation, how to accomplish the drill plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes, because drilling errors can add significant cost to drilling operations. In some cases, drilling errors may permanently lower the output of a well, resulting in substantial long term economic losses due to the lost output of the well. In worst-case scenarios, errors may be catastrophic and result in death of rig personnel.

Formation kicks, which can lead to a blowout, are often identified by obtaining measurements (e.g., fluid pressure) taken at a choke manifold downstream of the blowout preventer. Taking such line measurements downstream from the blowout preventer, however, can result in inaccurate readings of actual conditions. The increasing complexity of wells and drilling operations may increase the risk of a blowout. Accordingly, there is a need to improve measurement capabilities and minimize the chance of incorrect (e.g., inaccurate) measurements and actions or inactions taken as a result of an incorrect measurement.

Referring now to the drawings, FIG. 1 illustrates a drilling system 100 in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture (e.g., drilling mud 153) from a mud pit 154 into drill string 146. Mud pit 154 is shown schematically as a container, but it is noted that various receptacles, tanks, pits, or other containers may be used. Drilling mud 153 may flow from mud pump 152 into a discharge line 156 that is coupled to a rotary hose 158 by a standpipe 160. Rotary hose 158 may then be coupled to top drive 140, which includes a passage for drilling mud 153 to flow into borehole 106 via drill string 146 from where drilling mud 153 may emerge at drill bit 148. Drilling mud 153 may lubricate drill bit 148 during drilling and, due to the pressure supplied by mud pump 152, drilling mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, that may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10), and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using certain methods and systems for improved drilling performance.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys, and may perform the calculations described herein using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149, which is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a drill plan, a regional formation history, drilling engineer parameters, downhole toolface/inclination information, downhole tool gamma/resistivity information, economic parameters, and reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the drill plan or drilling parameters.

As noted, the input information may be provided to steering control system 168. After processing by steering control system 168, steering control system 168 may generate control information that may be output to drilling rig 210. Drilling rig 210 may provide feedback information using rig controls to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, and the drilling mode, among others. In certain operational modes, such as semi-automatic or automatic, steering control system 168 may generate output information indicative of instructions to rig controls to enable automatic drilling using the latest location of BHA 149. Therefore, an improved accuracy in the determination of the location of BHA 149 may be provided using steering control system 168.

Figure 2:
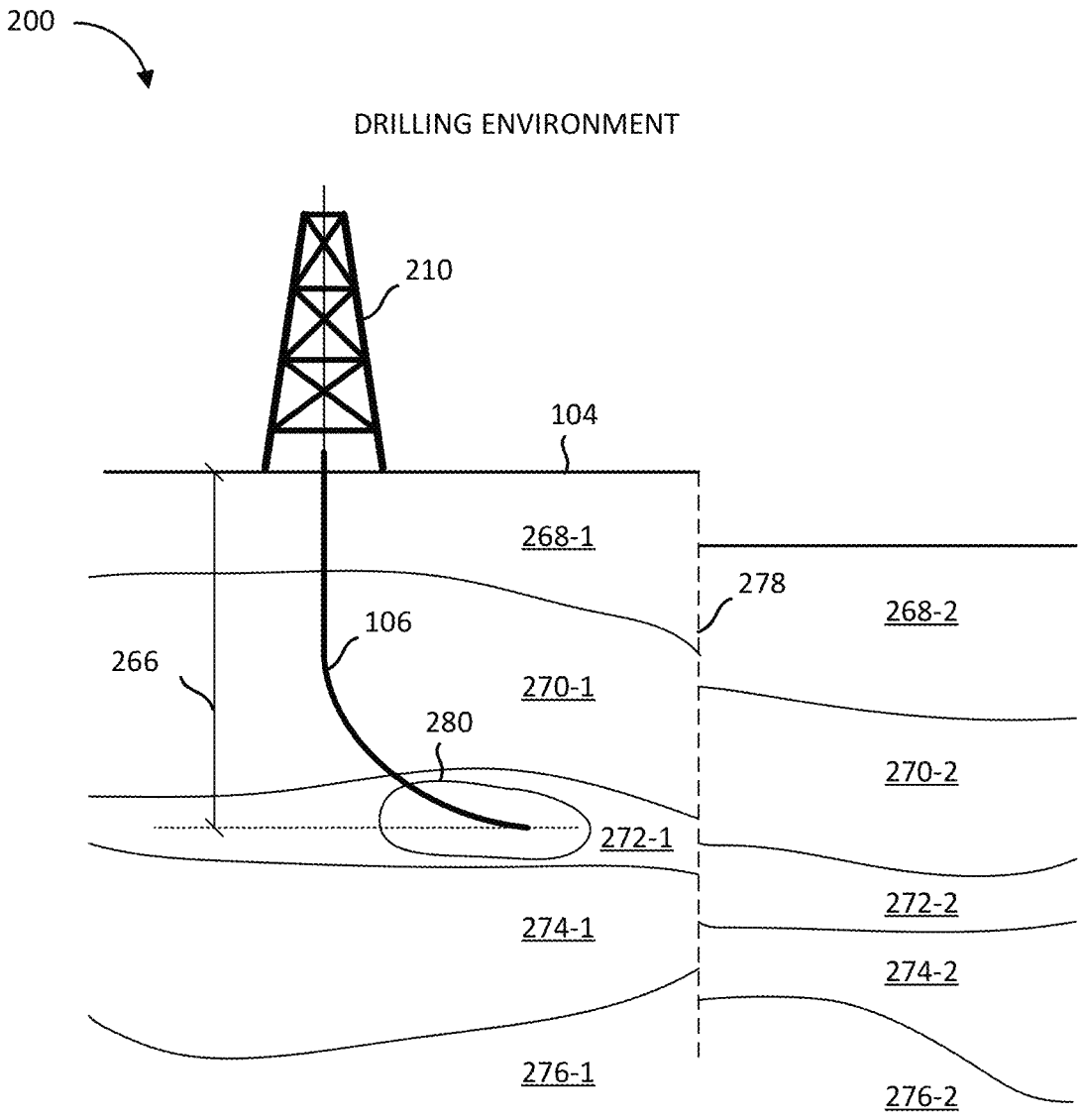
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drill plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drill plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size, and may be defined using various different methods and information in different embodiments. In some instances, target area 280 may be specified in the drill plan using subsurface coordinates, or references to certain markers, that indicate where borehole 106 is to be terminated. In other instances, target area may be specified in the drill plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106, but may involve staying within a strata layer that varies in depth and thickness as illustrated by strata layer 172. As such, directional drilling may involve multiple vertical adjustments that complicate the trajectory of borehole 106.

Figure 3:
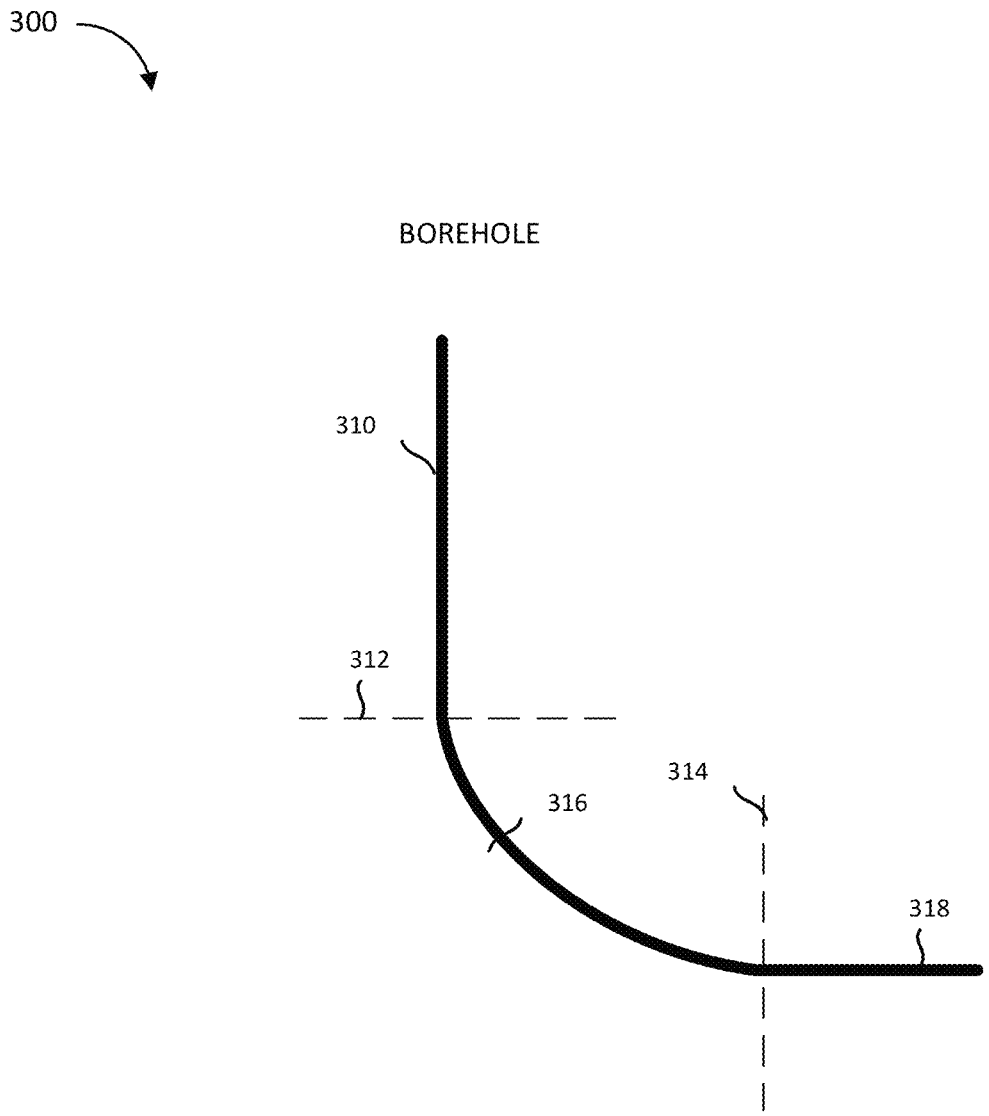
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kick off point 312 in vertical portion 310 and may end at a begin point 314 of horizontal portion 318. The change in inclination in buildup section 316 per measured length drilled is referred to herein as a "build rate" and may be defined in degrees per one hundred feet drilled. For example, the build rate may have a value of 6°/100 ft., indicating that there is a six degree change in inclination for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and re-drilled along a different path. Such mistakes may be undesirable due to the additional time and expense involved. However, if the built rate is too cautious, additional overall time may be added to the drilling process, because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding," are commonly used to form a borehole 106. Rotating, also called "rotary drilling," uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string. Instead, the mud motor uses hydraulic power derived from the pressurized drilling mud that circulates along borehole 106 to and from the surface 104 to directionally drill borehole 106 in buildup section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a toolface is confirmed that indicates a direction of the bend of the mud motor is oriented to a direction of a desired deviation (i.e., build rate) of borehole 106. Once the desired orientation of the mud motor is attained, WOB to the drill bit is increased, which causes the drill bit to move in the desired direction of deviation. Once sufficient distance and angle have been built up in the curved trajectory, a transition back to rotating mode can be accomplished by rotating the drill string again. The rotation of the drill string after sliding may neutralize the directional deviation caused by the bend in the mud motor due to the continuous rotation around a centerline of borehole 106.

Figure 4:
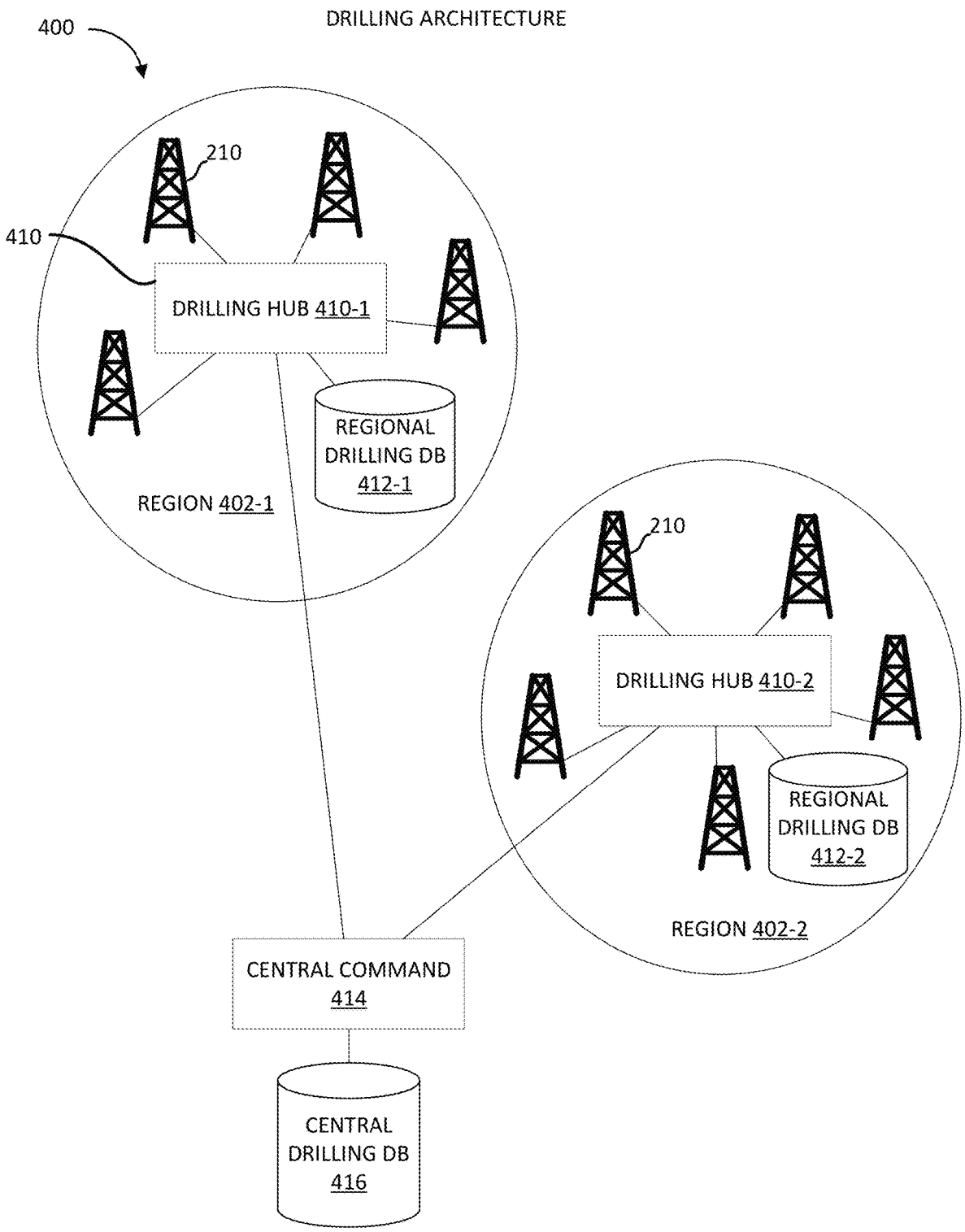
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic example of FIG. 4. Additionally, drilling hub 410-1 may have access to a regional drilling DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic example of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402, and may be in different stages of drilling through the depths of formation strata layers at region 402. Thus, for any given well being drilled by drilling rig 210 in a region 402, survey data from the reference wells or offset wells may be used to create the drill plan, and may be used for improved drilling performance. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412, or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drill plan for drilling rig 210 may include processing and analyzing the collected data in regional drilling DB 412 to create a more effective drill plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5B:
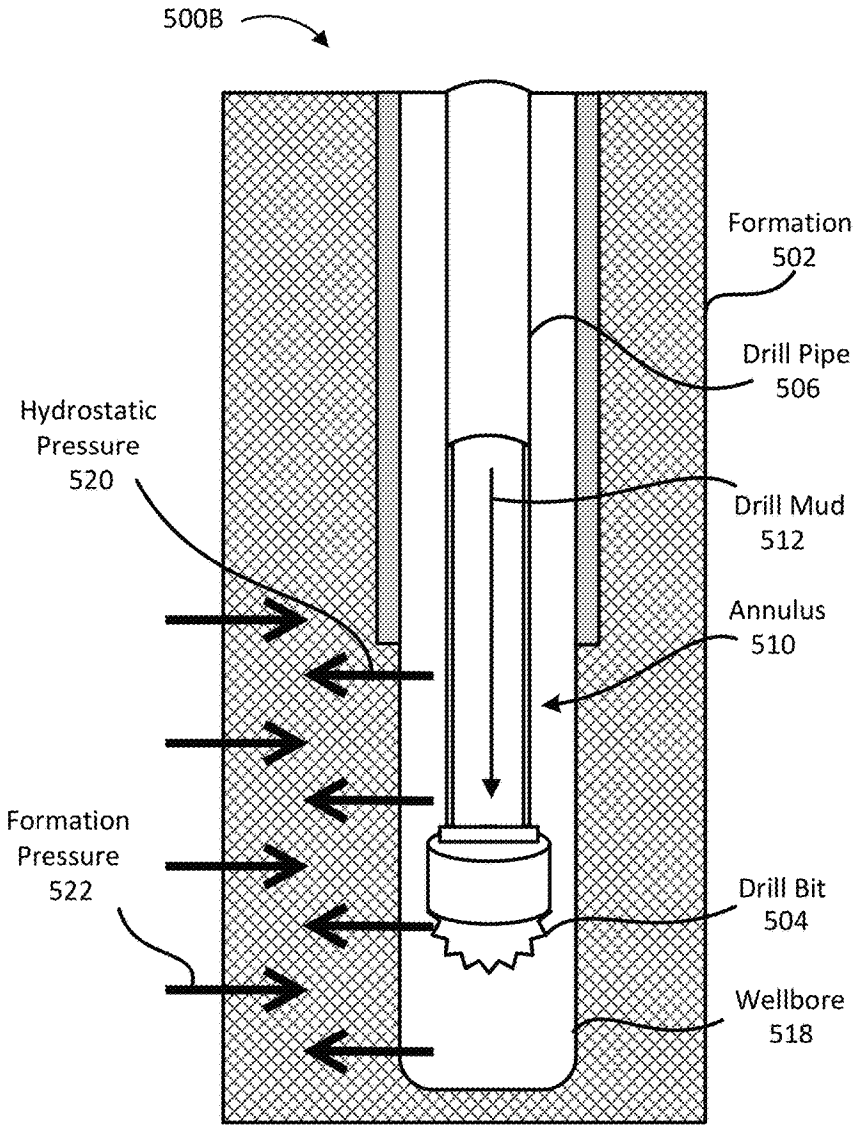
FIG. 5B illustrates a detailed embodiment of pressure influences on the wellbore of FIG. 5A.
Figure 5A:
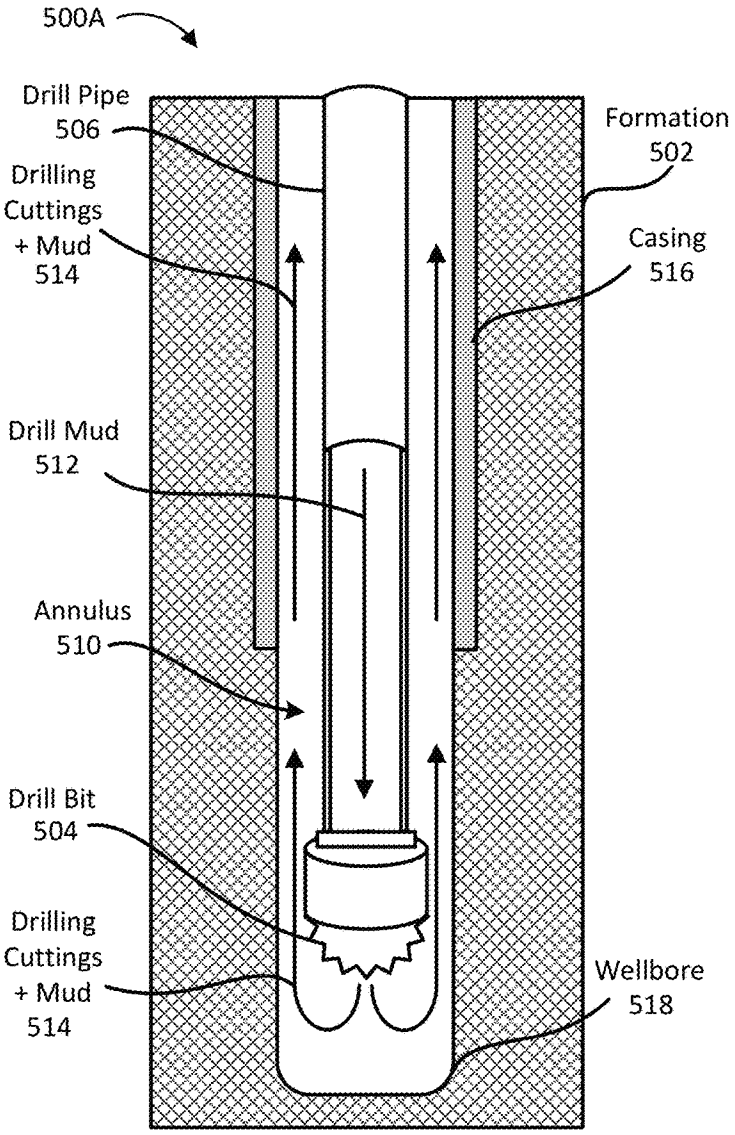
FIG. 5A is a cross-sectional view of a wellbore during drilling.

Referring now to FIG. 5A, a cross-sectional view 500A of a wellbore 518 during drilling is depicted. It should be understood that view 500A is a schematic and not drawn to scale or perspective. The view 500A may illustrate additional details with respect to the drilling system 100 shown in FIG. 1. For example, view 500A may depict a close-up view of the borehole 106 during drilling.

Due to friction generated between the drill bit 504 and the formation 502 during drilling, drilling mud 512 may be fed through drill pipe 506 to lubricate the drill bit 504. Another purpose of the drilling mud 512 is to bring drill cuttings (e.g., rock fragments) and drilling mud 514 to the surface. Thus, after lubricating the drill bit 504, the drilling mud 512 is recirculated up through an annulus 510 to the surface of the wellbore 518 along with the drilling cuttings 514. The annulus 510 may be formed between the drilling pipe 506 and well casing 516.

As illustrated, during a drilling operation, a drill bit 504 may drill through a formation 502. Formation 502 may be similar or the same as formation 102. Pressure fluctuations in the drilling mud can be a significant concern during a drilling operation. The formation 102 may be formed from porous rock. The pore spaces within the formation 102 contain fluid (e.g., natural gas, oil, and/or water) that is naturally pressurized at the formation pressure or pore pressure. During drilling operations, drilling crews and well planners work to prevent these formation fluids from entering the wellbore 518 and reaching the surface in an uncontrolled manner. A hydrocarbon influx, or kick, into a well or annulus 510 can lead to dangerous conditions when the kick is not detected and controlled.

Referring now to FIG. 5B, a detailed embodiment 500B of pressure influences on the wellbore 518 of FIG. 5A is provided. As shown, the drilling mud in the wellbore 518 exerts a hydrostatic pressure 520 onto the formation 502 and the formation 502 exerts a formation pressure 522 onto the walls of the wellbore 518.

The drilling mud 512 inside the wellbore 518 can be used to form a barrier to prevent formation fluids such as oil and/or gas from entering the wellbore 518. This is achieved by maintaining the pressure of the drilling mud inside the wellbore 518 above the formation pressure 522 by using the hydrostatic pressure 520 produced by the column of drilling mud 512 in the well. As long as the column of drilling mud 512 inside the well exerts hydrostatic pressure 520 on the formation 502 that is higher than the formation pressure 522, gas or other fluids in the formation 502 should not flow into the well.

To maintain this pressure barrier, the pressure of the drilling mud is monitored. When no drilling mud 512 is being pumped into the well, the formation pressure 522 is greater than the pressure inside the static well. To counter the formation pressure 522, and overcome the frictional resistance of the drill mud 512 to flow, additional pressure is added to push the drilling mud 512 down the drill pipe 506 and make it flow back up the annulus 510 to the surface. The frictional loss in the annulus 510 is called annular pressure loss (APL). The additional pressure applied to pump the drilling mud 512 may be used to control the hydrostatic pressure 520 of the well.

The hydrostatic pressure 520 at the various depths in the wellbore 518 is determined by both the height of the mud column and the density of the drilling mud 512. A higher density mud results in a higher hydrostatic pressure, and a lower density mud results in a lower hydrostatic pressure, all else being equal. If the drilling mud pressure in the wellbore 518 is too high, the formation 502 can be fractured and result in losses of drilling mud 512 into the formation 502. If the drilling mud pressure in the wellbore 518 is too low, fluids in the formation 502 can enter the wellbore 518 (e.g., gas influx). In conventional drilling operations, also called overbalanced drilling, a mud density is chosen within a range intended to keep formation fluids out of the well without fracturing any formations.

Drilling crews can monitor the drilling mud returned from wellbore 518 at the surface for an influx of formation fluids. An influx can be detected by monitoring for an increase in drilling mud 512 volume in the mud pits, or for increased overall fluid flow coming out of the well, such as an output flow rate that exceeds the input flow rate. Line pressure is often used to determine the overall fluid flow coming out of the well. An increase in drilling mud 512 volume or an increase in fluid flow from the well can be an indication of a formation influx into the well or expansion of an influx already inside the wellbore 518.

Figure 6:
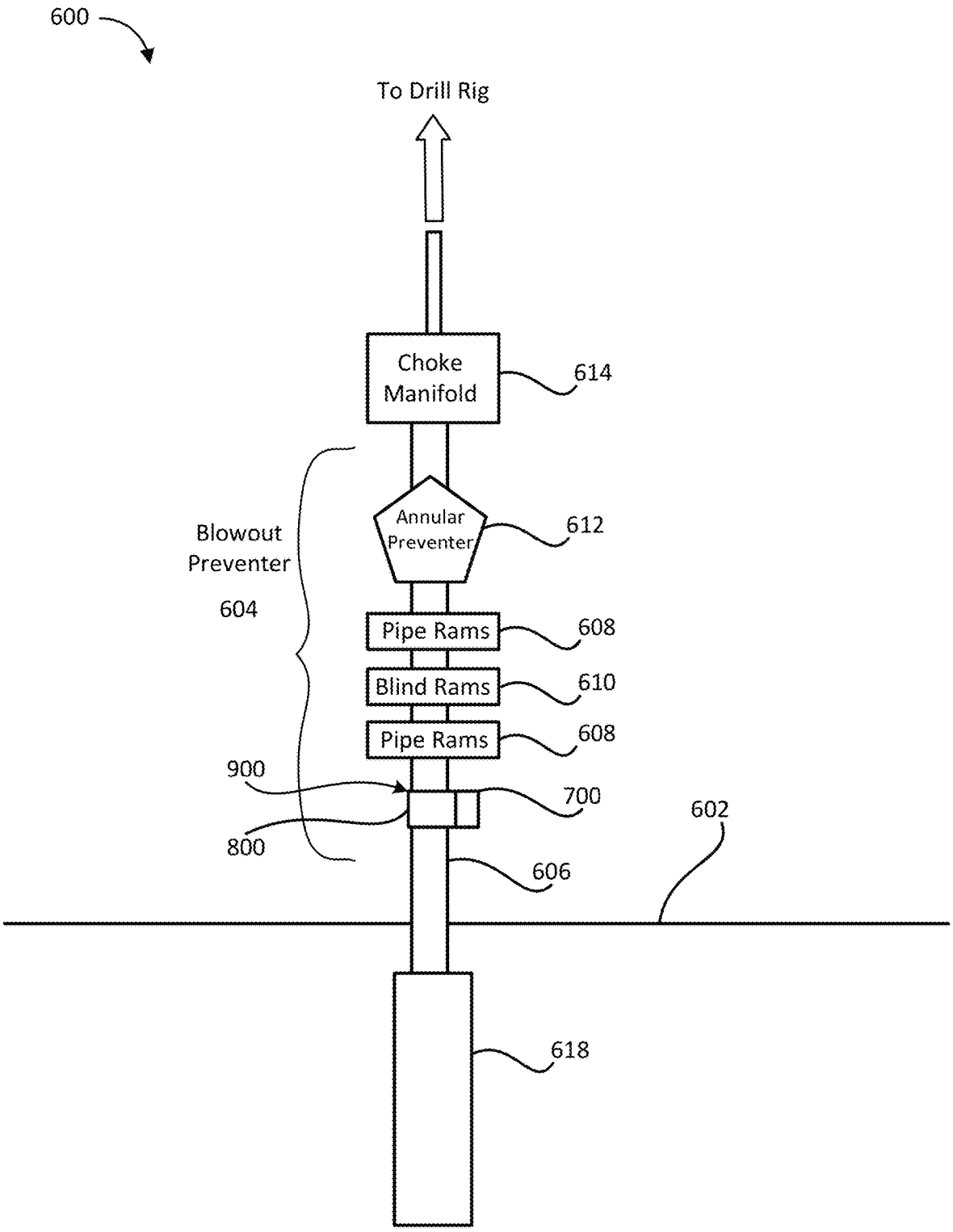
FIG. 6 illustrates a blowout preventer system, according to an embodiment herein.

To prevent or minimize influx damage, a blowout preventer is often installed at the surface of the wellbore 518. Turning now to FIG. 6, a schematic diagram of a blowout preventer system 604, according to an embodiment, is illustrated. Blowout preventer system 604 is generally positioned at the surface 602 of a well 618. That is, the blowout preventer system 604 is installed at or near to the location where drilling pipe 606 from the well 618 breaks the surface 602. In some embodiments, the surface 602 of the well 618 may be the seafloor, such as in the case of off-shore drilling. In other embodiments, the surface 602 of the well 618 may be the land through which the drill pipe 606 exits the well 618, such as in the case of on-shore drilling. The surface 602 of the well 618 is also known as the wellhead.

The blowout preventer system 604 may include a stack or arrangement of devices to prevent any influx of fluids from continuing into downstream systems. For example, the blowout preventer system 604 may include one or more pipe rams 608, one or more blind rams 610, and in some cases an annular preventer 612. A pipe ram 608 includes two steel rams that close around the drill pipe 606 to seal the well 618. A blind ram 610 includes two rams that close to seal the well 618 when the drill pipe 606 is not present. And the annular preventer 612 is a device that uses an elastomeric seal to seal around any variety of drilling pipes, components, or equipment. Each of the pipe rams 608, the blind ram 610, and the annular preventer 612 only seal their respective components when the blowout preventer system 604 is engaged. In some embodiments, each of these devices can be individually engaged by drilling crew in the event of an influx.

A choke manifold 614 can be installed downstream of the blowout preventer system 604. The choke manifold 614 can include a various combination of chokes and manifolds that are used to monitor and/or manage pressure fluctuations encountered during the drilling operation. To manage pressure fluctuations, and ultimately maintain stable line conditions, the choke manifold 614 diverts incoming fluid flow through a series of valves and chokes to step down or step up line pressure. In the event of an influx, line conditions can be extreme, such as for example, having line pressure ranging from 5,000 to 20,000 psi. Thus, to prevent damage to downstream systems caused by the extreme line conditions, the choke manifold 614 is used to mitigate the line conditions.

To monitor the well 618 for an influx of fluid, line measurements may be taken at the choke manifold 614. Line measurements are taken at the choke manifold 614 because conventional measurement devices can only be installed at the choke manifold 614. For example, conventional pressure transducers use threaded connections for installation. Threaded connections cannot withstand extreme line conditions and can be a line failure point in the event of a high pressure event, such as an influx. Thus, pressure transducers are often installed at the choke manifold 614 where line conditions can be normalized.

Measuring line conditions at the choke manifold 614, however, can lead to inaccurate estimates of line conditions at the blowout preventer 604. A notable incident at the Pryor Trust Well in Oklahoma in 2018 was caused by an inaccurate reading at the choke manifold 614 which led to loss of life and extensive equipment and well damage. Measuring line conditions at the blowout preventer 604, instead of at the choke manifold 614, could have prevented the incident by providing a more accurate reading of line conditions.

Turning now to FIGS. 7A-10, a transducer assembly is provided for taking measurements at a blowout preventer, such as blowout preventer 604. The transducer assembly may allow for a transducer, such as a temperature or pressure transducer, to be inserted inline at the blowout preventer. The transducer assembly provided herein can withstand the extreme line conditions exerted during a drilling operation, thereby allowing for measurements to be taken at the blowout preventer and thereby providing more accurate measurements to detect a kick (e.g., indicating an imminent blowout). In some embodiments, the transducer assembly may allow for a sensor, such as a temperature or pressure sensor, to be inserted inline at the blowout preventer. For the ease of example the following discussion is with respect to a transducer, however, it should be understood that the below discussion could also apply to a sensor. Moreover, while the following discussion relates to a single transducer in the transducer assembly, it should be understood that the transducer assembly may be configured to receive more than one transducer.

Figure 7B:
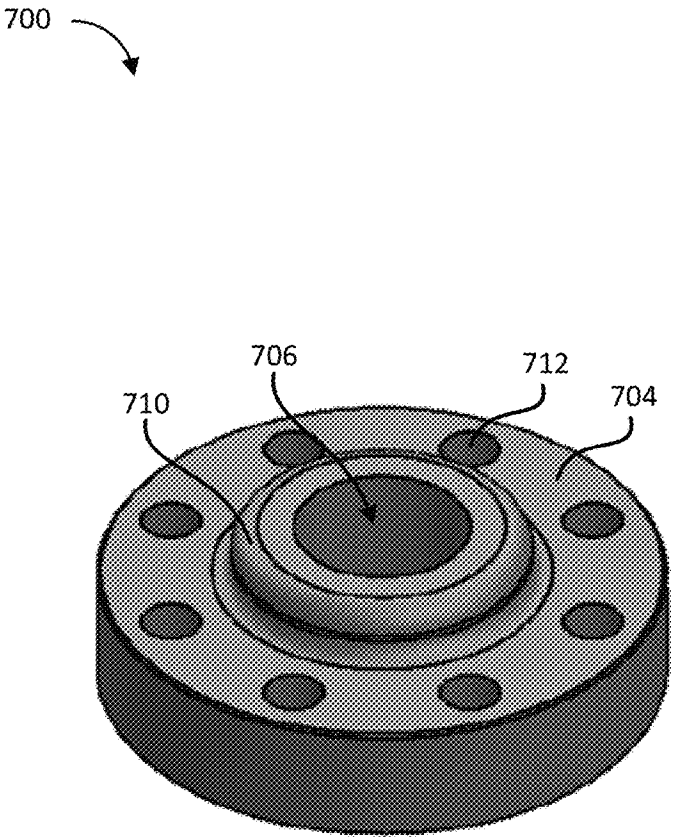
FIG. 7B illustrates another view of the transducer flange of FIG. 7A, according to an embodiment herein.
Figure 7A:
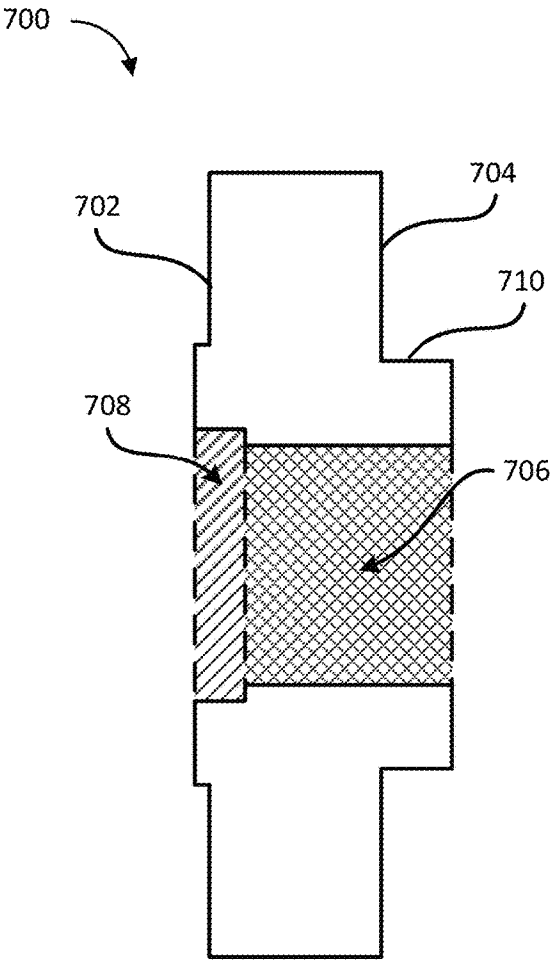
FIG. 7A illustrates a cross-sectional view of a transducer flange, according to an embodiment herein.

Starting with FIG. 7A, a cross-sectional view of a transducer flange 700, according to an embodiment herein is provided. The transducer flange 700 may be part of the transducer assembly. In some embodiments, the transducer flange 700 may be a blind flange.

The transducer flange 700 may include a bottom side 702 and a top surface 704. The bottom side 702 may be configured to contact a flange block, such as the flange block discussed in greater detail below, and the top surface 704 may be configured to face an external environment to the transducer assembly. A central orifice 706 may extend from the bottom side 702 to the top surface 704. The central orifice 706 may be configured to align with a port of a transducer block.

The transducer flange 700 may be configured to secure and seal a transducer to a transducer block when assembled. To secure a transducer, the central orifice 706 may include a seat 708. As discussed in greater detail below, the seat 708 may be adapted to removably receive and secure a transducer in position when the transducer assembly is assembled. In some embodiments, the transducer flange 700 may include a neck 710 for stabilizing a transducer in position. As illustrated, the central orifice 706 may extend through the neck 710.

FIG. 7B illustrates a topside-oriented view of the transducer flange 700. As illustrated, the transducer flange 700 may include a plurality of bolt holes 712. In some embodiments, the transducer flange 700 may be bolted to the transducer block via the bolt holes 712 to form the transducer assembly. Although the bolt holes 712 are depicted as spaced around the circumference of the top surface 704 of the transducer flange 700, any arrangement of the bolt holes 712 is contemplated herein.

Figure 8B:
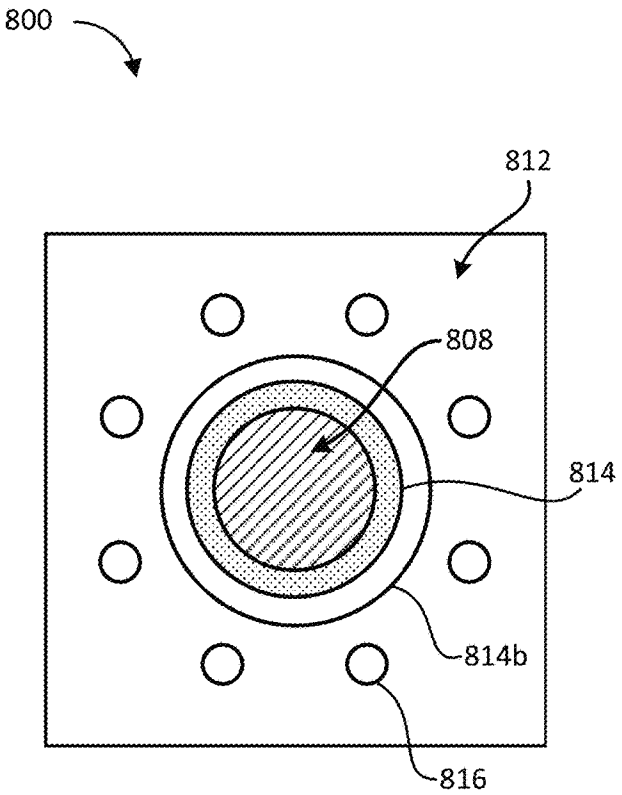
FIG. 8B illustrates a top-down view of the transducer block of FIG. 7B, according to an embodiment herein.
Figure 8A:
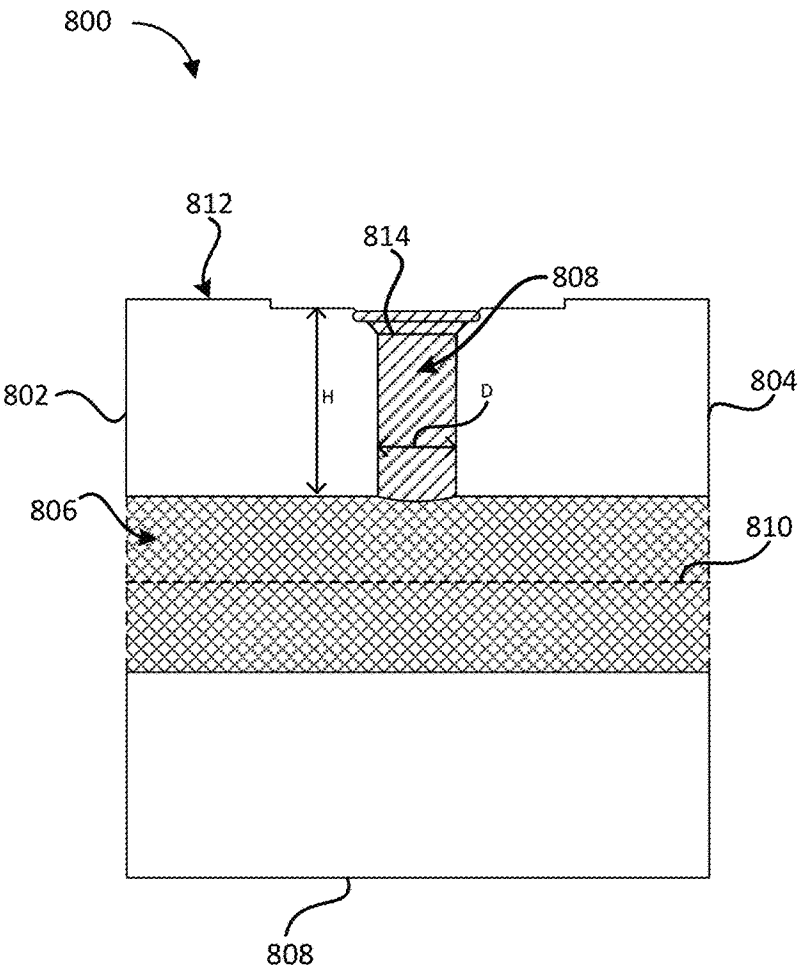
FIG. 8A illustrates a cross-sectional view of a transducer block, according to an embodiment herein.

Turning now to FIG. 8A, a side view of transducer block 800 is provided. The transducer block 800 includes a first surface 802 and a second surface 804. The first surface 802 and the second surface 804 may be configured to align with a pipe or fluid pathway having drilling mud therein. For example, the transducer block 800 may be configured to align with the drilling pipe 606 or a process line stemming from drilling pipe 606 so as to receive at least a portion of the drilling mud and fluid flowing from the well 618. The transducer block 800 may include a central channel 806 extending from the first surface 802 to the second surface 804. The central channel 806 may be sized to receive at least a portion of the fluid flowing from the well 618. For example, the central channel 806 may be sized similar to how pipes or lines are sized within drilling and refining operations. In some embodiments, the central channel 806 may be sized according to the pipe that feeds the fluid to the transducer block 800.

The transducer block 800 may also include a port 808. The port 808 may extend from a top surface 812 to the central channel 806. For example, as illustrated, the top surface 812 may be perpendicular to the first and second surfaces 802 and 804. Thus, the port 808 may be perpendicular to the central channel 806. The port 808 may be sized and positioned such to insert at least a portion of a transducer into the central channel 806. For example, the height, H, of the port 808 may be sized such that the sensor-end of a transducer, when inserted into the port 808, is positioned in the central channel 806. In some embodiments, the height, H, of the port 808 may be sized such that the sensor-end of an inserted transducer is positioned approximately near a central axis 810 of the central channel 806. Positioning the sensor-end of a transducer along the central axis 810 of the central channel 806 may provide a more accurate reading of the measured value than if the sensor-end of the transducer is positioned near the sides of the central channel 806 due to fluid mechanics.

The port 808 may be cylindrical and have a diameter, D. The diameter, D, may be sized to fit the body of a transducer. For example, the diameter, D, of the port 808 may be sized to the body of the transducer such that fluid from the central channel 806 does not travel up the port 808. In some embodiments, when the transducer is inserted into the port 808 a seal is formed between the transducer and the port 808, thereby not allowing any fluid flowing through the central channel 806 into the port 808.

The port 808 may include a seat 814. The seat 814 may be located towards the top surface 812 and form a seat for the inserted pressure transducer. Turning now to FIG. 8B, a top-down view of the transducer block 800 is provided. For example, the top-down view may be viewing the top surface 812 of the transducer block 800. As illustrated, the top surface 812 may include the port 808. The seat 814 may be positioned to form a seal with an inserted transducer. In some embodiments, the seat 814 may also include a second ledge 814*b*. The second ledge 814*b* may allow seat 814 to accommodate different size transducers.

The transducer block 800 may include a plurality of bolt holes 816. The bolt holes 816 may be drilled into or otherwise formed in the transducer block 800 in any configuration such to allow a transducer flange, such as the transducer flange 700, to be affixed to the top surface 812.

Figure 9A:
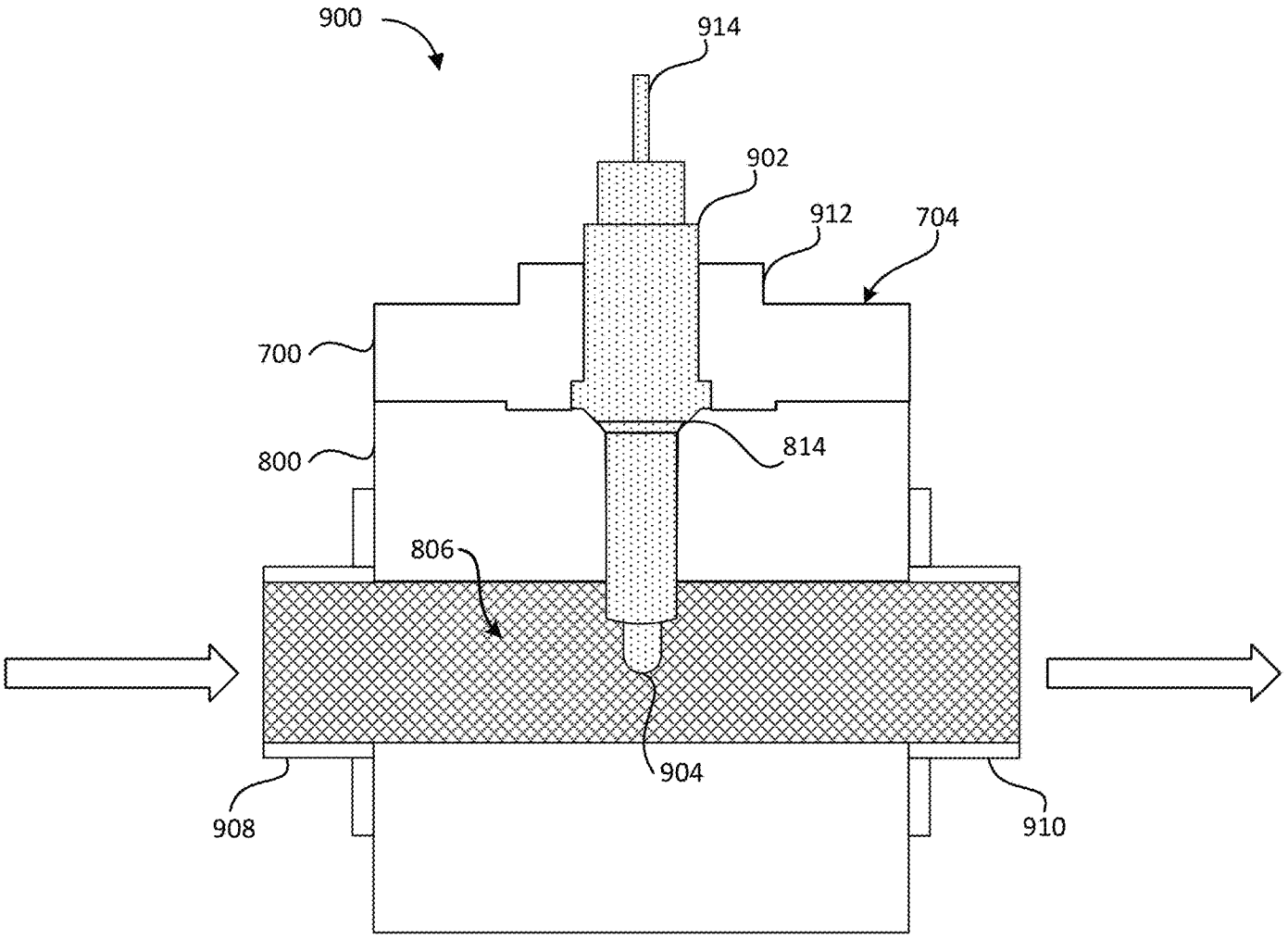
FIG. 9A illustrates a cross-sectional view of a transducer assembly, according to an embodiment herein.

FIG. 9A depicts a cross-sectional view of a transducer assembly 900, according to one embodiment. For ease of discussion, FIG. 9A is discussed with reference to FIGS. 7A-8B. The transducer assembly 900 may include the transducer flange 700 affixed to the transducer block 800. The transducer flange 700 may be affixed to the transducer block 800 by bolts. It should be understood, however, that any other known means of affixing the transducer flange 700 to the transducer block 800 is contemplated herein. For example, in some embodiments, the transducer flange 700 may be welded to the transducer block 800.

As illustrated, a transducer 902 is inserted in the transducer assembly 900. The transducer 902 may be a transducer configured to measure one or more of pressure, temperature, density, viscosity, flow rate, or stream composition. As noted above, the transducer 902 may be a sensor according to some embodiments of the present disclosure. The transducer 902 may be positioned to form a seal with the seat 814. In some embodiments, an O-ring, gasket, or another type of sealing-ring (not shown) may be positioned in the seat 814 to help seal the location between the transducer 902 and the seat 814. The transducer flange 700 may include a neck 912 at the top surface 704. The neck 912 may provide support to the body of the transducer 902.

A sensor-end 904 of the transducer 902 may be positioned in the central channel 806 of the transducer block 800. The central channel 806 may be positioned to align with an inlet pipe 908 and an outlet pipe 910. Fluid from a well, such as well 618, may be directed through the central channel 806 and one or more measurements may be taken by the transducer 902. The transducer 902 may include a transmitter 914. The transmitter 914 may transmit measurements taken by the transducer 902 to an instrument block, instrument indicator, or control system. In some embodiments, the transmitter 914 may be hardwired to the instrument block, indicator, or control system. In some embodiments, the control system may include a computer system for monitoring measurement data.

Figure 9B:
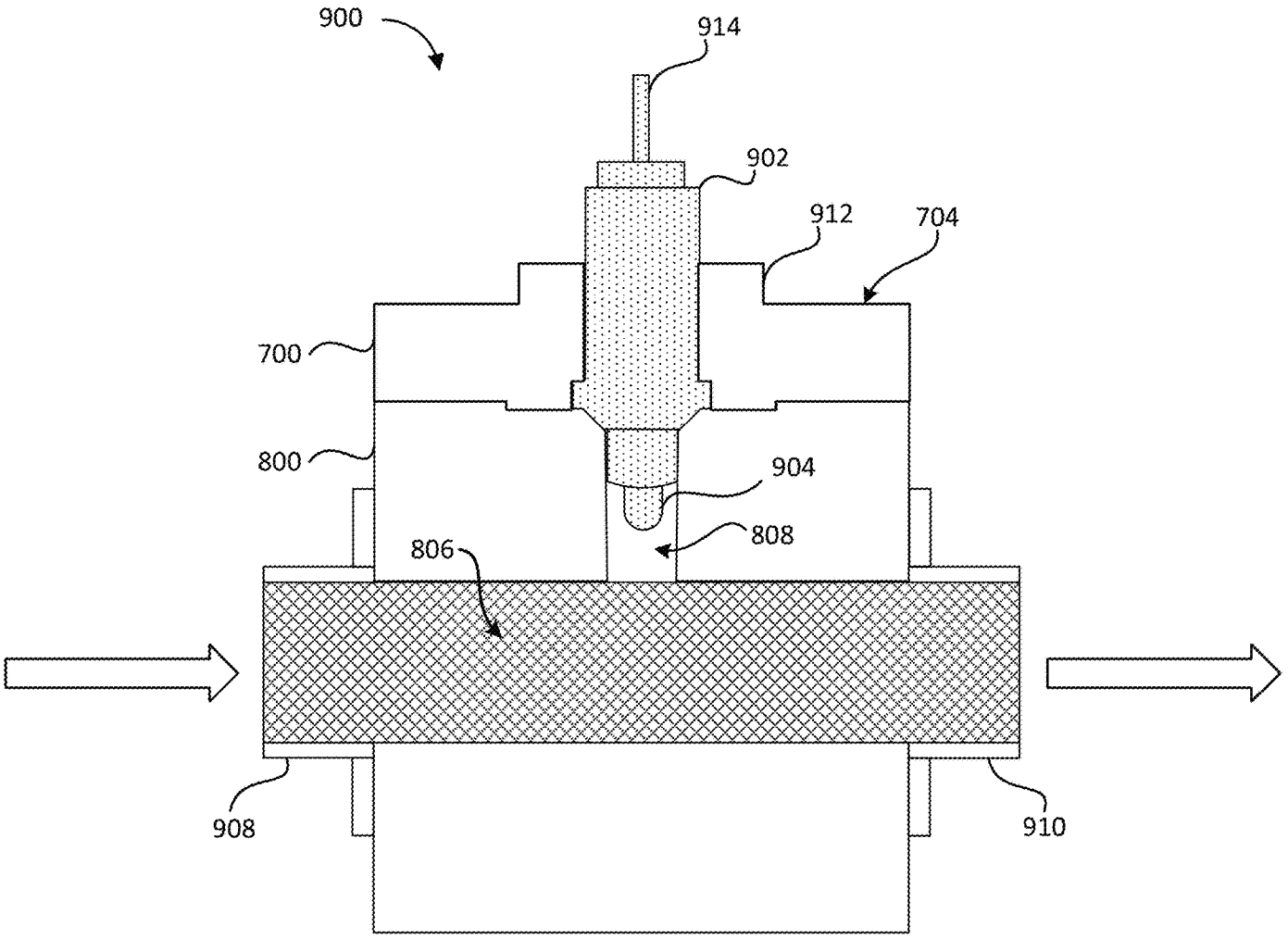
FIG. 9B illustrates a cross-sectional view of the transducer assembly from FIG. 9A, according to another embodiment herein.

FIG. 9B depicts a cross-sectional view of an alternative embodiment of the transducer assembly 900. As depicted in FIG. 9B, in some embodiments the sensor-end 904 of the transducer 902 may not be positioned in the central channel 806. Instead, the sensor-end 904 may be positioned in the port 808 of the transducer block 800. In this embodiment, fluid flowing through the central channel 806 may fill into the port 808, thus allowing the sensor-end 904 to take a measurement or reading.

The positioning of the sensor-end 904 may depend on the fluid conditions from the well and/or the line condition being measured. For example, when measuring the flow rate of the fluid flowing through the channel 806, the sensor-end 904 may be positioned in the central channel 806, as illustrated by FIG. 9A. In contrast, when measuring the pressure of the fluid flowing through the channel 806, the senor-end 904 may be positioned in the port 808. Positioning the sensor-end 904 in the port 808 may allow line measurements to be taken without disturbing the fluid flow through the central channel 806. In some cases, the high pressure or temperature of the fluid flowing through the central channel 806 may influence the positioning of the sensor-end 904 in the port 808. In other cases, the positioning of the sensor-end 904 may be determined by the size of the transducer 902.

Figure 10:
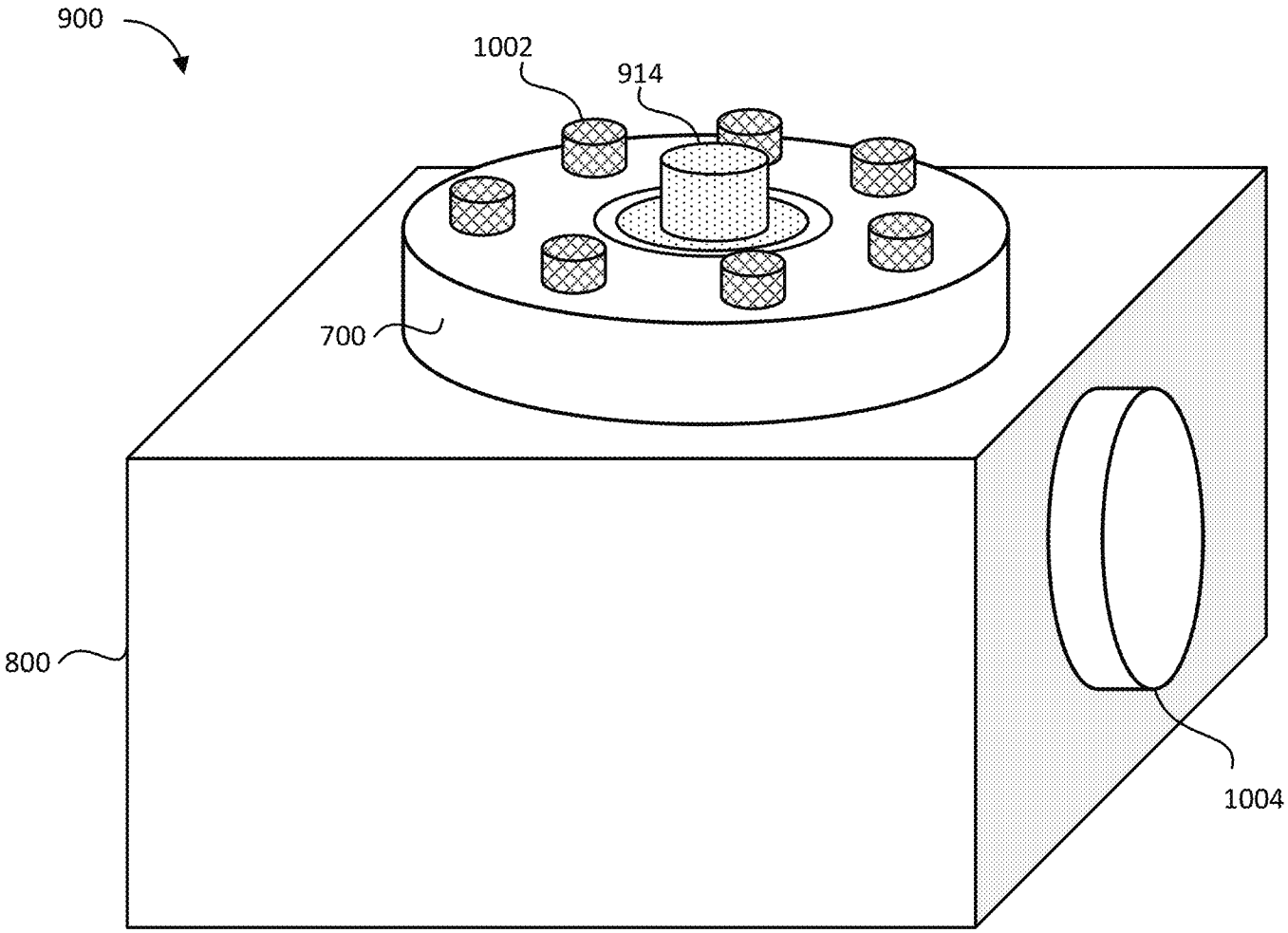
FIG. 10 illustrates a transducer assembly, according to an embodiment herein.

Turning now to FIG. 10, a perspective view of the transducer assembly 900 is provided. As shown, the transducer flange 700 is affixed to the transducer block 800. In this embodiment, the transducer flange 700 is affixed by bolts 1002. The bolts 1002 may be inserted through bolt holes 712 of the transducer flange 700 and into the bolt holes 816 of the transducer block 800 to form the transducer assembly 900. When assembled, the transmitter 914 of the transducer 902 may extend out of the transducer flange 700. As noted above, the transmitter 914 may be connected to an instrument block or the like.

As noted above, the transducer assembly 900 may connect to an inlet pipe 908 and an outlet pipe 910. In some embodiments, to allow for connection to the inlet pipe 908 and the outlet pipe 910, the transducer assembly 900 may include a connection 1004. The connection 1004 may depend on the top of pipe and pipe connection of the inlet and outlet pipes 908 and 910. For example, in some embodiments, the connection 1004 may be a flange.

The transducer assembly 900 may be provided as part of a blowout preventer. The flange assembly 900 provides a safe and secure means for taking line measurements at the blowout preventer. As discussed above, measurements at the blowout preventer can allow for accurate readings and detection of events. Events may include deviation of operating conditions from a normal operating range. At a given threshold, an event may be determined and appropriate steps may be taken in accordance with the event. For example, changes to fluid pressure in the wellbore may indicate an influx of an unexpected fluid into the wellbore. Such an influx can lead to dangerous events such as well blow-outs. By monitoring the operating conditions and determining or predicting an event, appropriate actions can be taken to prevent or mitigate a dangerous condition. In the preceding example, a blowout preventer can be engaged to stop fluid flow from the wellbore.

Figure 11:
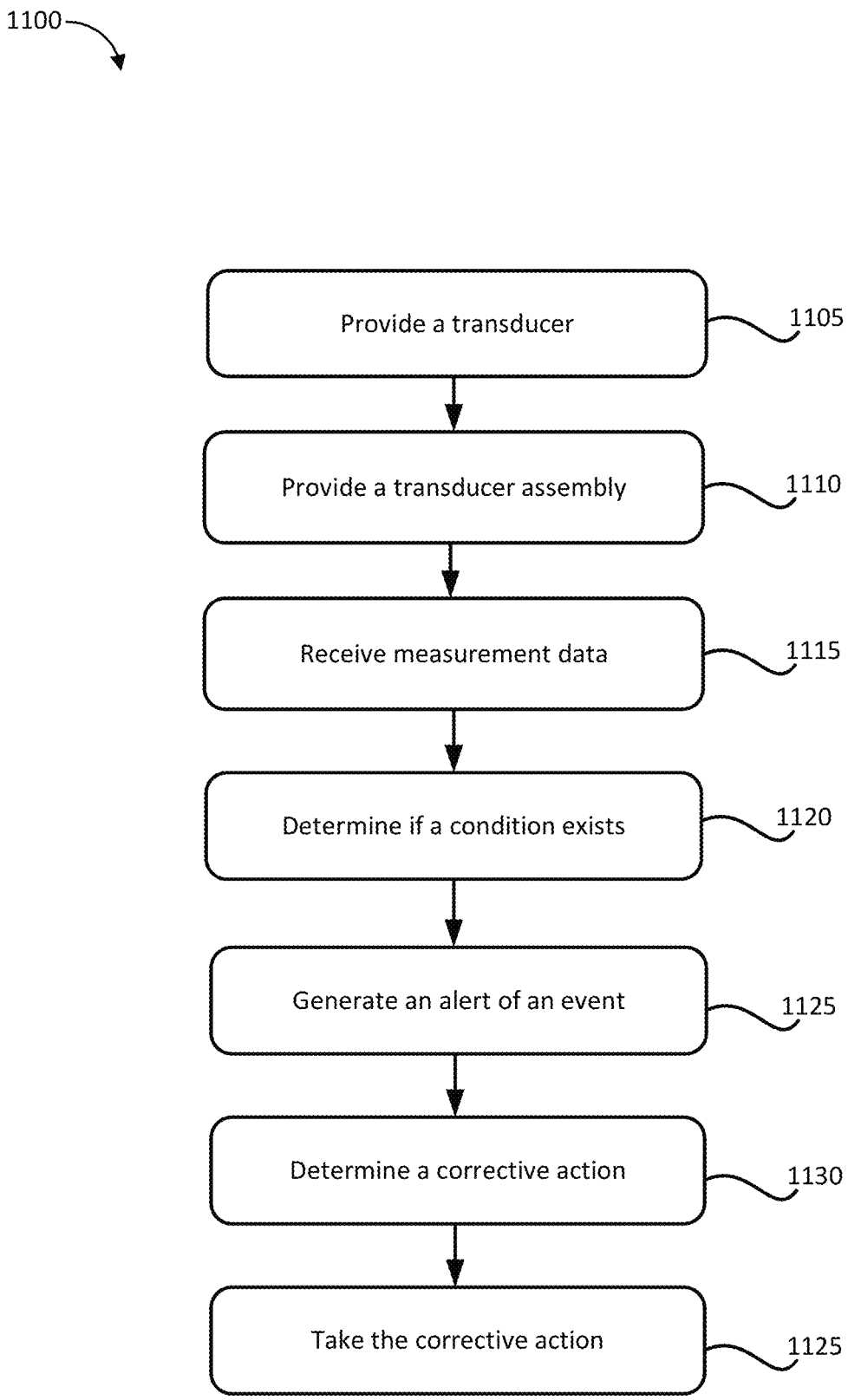
FIG. 11 illustrates one embodiment of a flow chart describing a method determining a condition during drilling of a well, according to an embodiment herein.

Turning now to FIG. 11, a method 1100 for determining a condition during drilling of a well is provided. Method 1100 may include step 1105. At step 1105 a transducer may be provided. The transducer may be an instrument transducer that is used to measure stream conditions (e.g., take a line measurement) of a fluid in a wellbore. The transducer may be configured to measure a single stream condition, such as pressure, temperature, or flowrate. In example embodiments, the transducer may be a pressure transducer, a temperature transducer, or a flow rate transducer. The transducer may be configured to take a plurality of measurements of the single stream condition. The transducer may be coupled to a computer system. The computer system may be remote from the wellbore location or may be onsite. The transducer may transmit the plurality of measurements to the computer system.

At step 1110, a transducer assembly may be provided. The provided transducer assembly may be the same or similar to the transducer assembly 900. In an example embodiment, the transducer assembly may include a transducer block, such as transducer block 800. The transducer block may include a central channel having an inlet and an outlet. The inlet may be adapted to receive at least a portion of a fluid from a wellbore and the outlet may be adapted to discharge the fluid from the central channel. The transducer block may also include a port adapted to receive at least a portion of a transducer. For example, the transducer may be inserted into the port such that at least a portion of the transducer is located in the central channel. The port may include a channel extending from an external environment to the central channel.

The transducer assembly may also include a transducer flange having a central orifice, such as transducer flange 700. The central orifice may be configured to align with the port of the transducer block to create a seal between the transducer block and the transducer flange.

In some embodiments, the transducer assembly is provided as part of a blowout preventer. In such cases, the blowout preventer may include a body having a channel that is configured to receive fluid from the wellbore. The blowout preventer may also include one or more rams configured to block fluid flow through the channel when activated. The transducer assembly may be positioned to receive at least a portion of the fluid from the wellbore.

Method 1100 may include step 1115. At step 1115, measurement data from the transducer may be received. For example, the computer system may receive a plurality of measurements from the transducer. Upon receiving the plurality of measurements, the computer system may analyze the plurality of measurements. The plurality of measurements may be evaluated in a given time period or individually. The computer system may analyze the plurality of measurements to look for an impending triggering event. For example, the computer system may analyze the plurality of measurements to determine a dramatic change in the fluid conditions (e.g., a spike or drop in measurements). For example, if the transducer is a pressure transducer ad the plurality of measurements are pressure measurements, the computer system may analyze the pressure measurements for a dramatic spike in fluid pressure in the wellbore. This may indicate a change in hydrostatic pressure in the well and potentially an influx of fluid into the wellbore.

At step 1120, the computer system may determine if a condition exists based on the measurement data received from the transducer. The condition may be predictive of an event. For example, an influx of hydrocarbons into the well (e.g., the condition) can be predictive of a blowout (e.g., the event). In one embodiment, to determine if a condition exists, the computer system may analyze the plurality of measurements against a threshold. For example, the plurality of measurements may be compared to a threshold. If one or more of the plurality of measurements exceeds the threshold, then the computer system may determine that conditions in the wellbore may indicate an event. Similarly, if one or more of the plurality of measurements falls below a threshold, then this may also indicate concerning conditions in the wellbore. In some embodiments, the plurality of measurements may be compared to a threshold range, meaning that if one or more of the plurality of measurements fall outside of the range, then an event may be determined.

The computer system may track and log the plurality of measurements from the transducer. If an event does occur, a log of the plurality of measurements may be used to evaluate the conditions of the wellbore during the event. The log may be used for learning purposes. In other embodiments, the log of the plurality of measurements may be used to develop and determine the threshold(s) for another wellbore in the same area. For example, if another wellbore is drilled nearby to the original wellbore, the plurality of measurements from the original wellbore may be used to determine the threshold (s) for the other wellbore.

If one or more of the plurality of measurements exceeds or falls below a threshold, an alert of an event may be generated at step 1125. The alert may be generated by the computer system. For example, computer system may generate a pop-up notification, an alarm, or any other indication to notify personnel that the threshold is exceeded. In some embodiments, the alert may be generated if one or more of the plurality of measurements falls below a threshold or outside of a threshold range. In still other embodiments, the alert may be generated if the computer system determines a dramatic change (e.g., spike or dip) in the plurality of measurements. A dramatic change in sequential measurements or measurements in a given time range may indicate an event.

At step 1130, a corrective action may be determined based on the alert. For example, upon receiving the alert, personnel who are alerted may determine whether corrective action and what corrective action is required to address the alert. In some embodiments, the corrective action may be notifying a superior of the alert or determining that further monitoring of the plurality of measurements is required. In other embodiments, the corrective action may include modifying one or more drilling parameters for drilling the wellbore. For example, the alert may indicate that the hydrostatic pressure in the wellbore is too low and that the flowrate of the drilling mud should be increased to increase the hydrostatic pressure in the wellbore.

In some embodiments, the alert may indicate an impending event that if not immediately corrected could lead to dangerous and/or costly conditions at the drilling site. In such cases, a more drastic corrective action may be determined. For example, based on the alert, the corrective action may be to stop drilling the well. In further cases, the corrective action may be to engage or activate the blowout preventer. For example, a dramatic change in the fluid pressure of the wellbore may cause the computer system to generate an alert. The alert may indicate conditions for a blowout and thus one or more rams of the blowout preventer may be engaged to prevent fluid flow out of the wellbore.

In some embodiments, the computer system may determine the corrective action to take based on the generated alert. For example, the computer system may recognize the decrease in fluid pressure in the wellbore and generate a notification indicating that the drilling mud flowrate should be increased. In other embodiments, personnel monitoring drilling of the wellbore may determine the corrective action based on the alert generated.

After determining the corrective action, method 1100 may include taking the corrective action at step 1135. For example, one or more drilling parameters may be modified based on the alert. Modifying the one or more drilling parameters may include one or more of: increasing drilling mud pressure, increasing density of the drilling mud, reducing WOB of drill string used to drill the well, reducing RPMs of the drill string, reducing ROP of the drill string, increasing measurement rate, and determining rate of change between consecutive measurements. In some cases, the rams of the blowout preventer may be engaged or moved to a first position in which the one or more rams prevent fluid flow from the well through the channel of the blow out preventer.

Implementations and methods of determining a condition during drilling of a well can be combined and used with the various systems and methods discussed throughout this disclosure. One of ordinary skill in the art can look to modify this method with any of the above-referenced embodiments without departing from the idea and spirit of the invention.

It will be appreciated by those skilled in the art having the benefit of this disclosure that this transducer assembly provides a safe and accurate way to monitor conditions of fluid in a wellbore during a drilling process. It should be understood that the drawings and detailed description herein are to be regarded in an illustrative rather than a restrictive manner, and are not intended to be limiting to the particular forms and examples disclosed. It will be understood that although specific values for different examples have been provided in the disclosure, such specific values are merely examples for descriptive purposes and are not limiting. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

EXAMPLES

These illustrative examples are mentioned not to limit or define the scope of this disclosure, but rather to provide examples to aid understanding thereof. Illustrative examples are discussed above in the Detailed Description, which provides further description. Advantages offered by various examples may be further understood by examining this specification As used below, any reference to a series of examples is to be understood as a reference to each of those examples disjunctively (e.g., "Examples 1-4" is to be understood as "Examples 1, 2, 3, or 4").

Example 1 is a blowout preventer comprising: a body comprising a channel, wherein the channel is configured to receive fluid from a wellbore; one or more rams, wherein the one or more rams are configured to block fluid flow through the channel when in a first position and, wherein the one or more rams are configured to allow fluid flow through the channel when in a second position; and a transducer assembly, wherein the transducer assembly comprises: a transducer block, wherein the transducer block comprises: a central channel having an inlet and an outlet, wherein the inlet is adapted to receive at least a portion of a fluid from a wellbore and the outlet is adapted to discharge the fluid from the central channel; and a port adapted to receive at least a portion of a transducer, wherein the port is in fluid communication with the central channel and comprises a channel extending from an external environment to the central channel; and a transducer flange having a central orifice, wherein the central orifice is configured to align with the port of the transducer block to create a seal between the transducer block and the transducer flange.

Example 2 is the blowout preventer of any previous or subsequent example, further comprising a drilling pipe, wherein: at least a portion of the fluid flow through the channel flows through the drilling pipe; and the transducer assembly is positioned to receive the portion of fluid flow from the drilling pipe.

Example 3 is the blowout preventer of any previous or subsequent example, wherein the transducer flange further comprises a seat.

Example 4 is the blowout preventer of any previous or subsequent example, wherein the port is perpendicular to the central channel of the transducer block.

Example 5 is the blowout preventer of any previous or subsequent example, further comprising a transducer, wherein the transducer is inserted into the port of the transducer block and positioned so that at least a portion of the transducer is positioned within the central channel of the transducer block.

Example 6 is the blowout preventer of any previous or subsequent example, wherein the transducer comprises one of a pressure transducer or a flow rate transducer.

Example 7 is the blowout preventer of any previous or subsequent example, further comprising a transducer, wherein the transducer is inserted into the port of the transducer block and positioned so that a sensor-end of the transducer is positioned within the port of the transducer block.

Example 8 is a transducer assembly comprising: a transducer block, wherein the transducer block comprises: a central channel having an inlet and an outlet, wherein the inlet is adapted to receive at least a portion of a fluid from a wellbore and the outlet is adapted to discharge the fluid from the central channel; and a port adapted to receive at least a portion of a transducer, wherein the port is in fluid communication with the central channel and comprises a channel extending from an external environment to the central channel; and a transducer flange having a central orifice, wherein the central orifice is configured to align with the port of the transducer block to create a seal between the transducer block and the transducer flange.

Example 9 is the transducer assembly of any previous or subsequent example, wherein the transducer assembly comprises a pressure transducer inserted through the central orifice of the transducer flange and into the port of the transducer block.

Example 10 is the transducer assembly of any previous or subsequent example, wherein the transducer assembly further comprises a neck around an external surface of the central orifice to provide support to the pressure transducer.

Example 11 is the transducer assembly of any previous or subsequent example, wherein the transducer block and the transducer flange are configured to bolt together to form the transducer assembly.

Example 12 is the transducer assembly of any previous or subsequent example, wherein the inlet of the transducer assembly further comprises a flange positioned to connect the inlet of the central channel to a drilling pipe so as to receive the fluid from the wellbore.

Example 13 is the transducer assembly of any previous or subsequent example, wherein the transducer block comprises a seat for the transducer.

Example 14 is the transducer assembly of any previous or subsequent example, further comprising a pressure transducer, wherein: the pressure transducer is positioned in the seat of the transducer block so that a first portion of the pressure transducer is inserted into the port of the transducer block; the transducer flange is positioned to receive a second portion of the pressure transducer through the central orifice; and the transducer flange is bolted to the transducer block to form the seal between the transducer block and the transducer flange.

Example 15 is the transducer assembly of any previous or subsequent example, wherein the port is perpendicular to the central channel.

Example 16 is the transducer assembly of any previous or subsequent example, wherein the transducer assembly is adapted to be coupled to a blowout preventer.

Example 17 is a method of determining a condition during drilling of a well, the method comprising: providing a transducer for taking a measurement of fluid from a well being drilled, wherein the transducer is coupled to a computer system; providing a transducer assembly, wherein the transducer assembly comprises: a transducer block, wherein the transducer block comprises: a central channel having an inlet and an outlet, wherein the inlet is adapted to receive at least a portion of the fluid from the well and the outlet is adapted to discharge the fluid from the central channel; and a port adapted to receive at least a portion of the transducer, wherein the port is in fluid communication with the central channel and comprises a channel extending from an external environment to the central channel; and a transducer flange having a central orifice, wherein the central orifice is configured to align with the port of the transducer block to create a seal between the transducer block and the transducer flange; and receiving, by the computer system, a plurality of measurements from the transducer; and determining, by the computer system, responsive to the measurements, if a condition exists.

Example 18 is the method of any previous or subsequent example, wherein the transducer is a pressure transducer and the plurality of measurements received by the computer system comprises a plurality of pressure measurements.

Example 19 is the method of any previous or subsequent example, wherein providing the transducer assembly comprises providing the transducer assembly as part of a blowout preventer, wherein: the blowout preventer comprises: a body comprising a channel, wherein the channel is configured to receive fluid from the well; and one or more rams, wherein the one or more rams are configured to block fluid flow through the channel when in a first position and, wherein the one or more rams are configured to allow fluid flow through the channel when in a second position; and the transducer assembly receives at least a portion of the fluid from the well.

Example 20 is the method of any previous or subsequent example, further comprising generating, by the computer system, an alert when one of the plurality of measurements is above a threshold.

Example 21 is the method of any previous or subsequent example, further comprising: determining, in response to the alert, a corrective action to be taken; and taking the corrective action.

Example 22 is the method of any previous or subsequent example, wherein taking the corrective action comprises engaging the one or more rams of the blowout preventer to prevent fluid flow through the channel.

Example 23 is the method of any previous or subsequent example, wherein taking the corrective action comprises modifying one or more drilling parameters of the well being drilled.

Example 24 is the method of any previous or subsequent example, wherein the corrective action comprises at least one of: increasing drilling mud pressure; increasing density of the drilling mud; reducing WOB of drill string used to drill the well; reducing RPMs of the drill string; reducing ROP of the drill string; increasing measurement rate; and determining rate of change between consecutive measurements.

Example 25 is the method of any previous or subsequent example, wherein the condition is predictive of an event.

Example 26 is the method of any previous or subsequent example, wherein the event is a blowout.

Example 27 is the method of any previous or subsequent example, wherein the condition is an influx of hydrocarbons into the well.

What is claimed is:

1. A blowout preventer comprising:

a body comprising a channel, wherein the channel is configured to receive fluid from a wellbore;

one or more rams, wherein the one or more rams are configured to block fluid flow through the channel when in a first position and, wherein the one or more rams are configured to allow fluid flow through the channel when in a second position; and a transducer assembly, wherein the transducer assembly comprises:

a transducer block, wherein the transducer block comprises:

a central channel extending from a first surface to a second surface, and having an inlet and an outlet, wherein the inlet is adapted to receive at least a portion of a fluid from a wellbore and the outlet is adapted to discharge the fluid from the central channel; and a port adapted to receive at least a portion of a transducer, wherein the port is in fluid communication with the central channel and comprises a channel extending from a top surface to the central channel; and a transducer flange having a central orifice extending from a bottom side to a top surface, wherein the bottom side is affixed to the top surface of the transducer block, the central orifice is configured to align with the port of the transducer block to create a seal between the transducer block and the transducer flange, and a transducer seat is formed in the bottom side of the transducer flange, wherein the transducer assembly is configured to take inline measurements of the fluid from the wellbore.

2. The blowout preventer of claim 1, further comprising a drilling pipe, wherein:

at least a portion of the fluid flow through the channel flows through the drilling pipe; and the transducer assembly is positioned to receive the portion of fluid flow from the drilling pipe.

3. The blowout preventer of claim 1, wherein the port is perpendicular to the central channel of the transducer block.

4. The blowout preventer of claim 1, further comprising the transducer, wherein the transducer is inserted into the port of the transducer block and positioned so that at least a portion of the transducer is positioned within the central channel of the transducer block.

5. The blowout preventer of claim 4, wherein the transducer comprises one of a pressure transducer or a flow rate transducer.

6. The blowout preventer of claim 1, further comprising the transducer, wherein the transducer is inserted into the port of the transducer block and positioned so that a sensor-end of the transducer is positioned within the port of the transducer block.

7. A transducer assembly comprising:

a transducer block, wherein the transducer block comprises:

a central channel extending from a first surface to a second surface, and having an inlet and an outlet, wherein the inlet is adapted to receive at least a portion of a fluid from a wellbore and the outlet is adapted to discharge the fluid from the central channel; and a port adapted to receive at least a portion of a transducer, wherein the port is in fluid communication with the central channel and comprises a channel extending from a top surface to the central channel; and a transducer flange having a central orifice extending from a bottom side to a top surface, wherein the bottom side is affixed to the top surface of the transducer block, the central orifice is configured to align with the port of the transducer block to create a seal between the transducer block and the transducer flange, and a transducer seat is formed in the bottom side of the transducer flange, wherein the transducer assembly is configured to take inline measurements of the fluid from the wellbore.

8. The transducer assembly of claim 7, wherein:

the transducer that the port is adapted to receive at least a portion of is a pressure transducer; and the transducer assembly comprises the pressure transducer inserted through the central orifice of the transducer flange and into the port of the transducer block.

9. The transducer assembly of claim 8, wherein the transducer assembly further comprises a neck around an external surface of the central orifice to provide support to the pressure transducer.

10. The transducer assembly of claim 7, wherein the transducer block and the transducer flange are configured to bolt together to form the transducer assembly.

11. The transducer assembly of claim 7, wherein the inlet of the transducer assembly further comprises a flange positioned to connect the inlet of the central channel to a drilling pipe so as to receive the fluid from the wellbore.

12. The transducer assembly of claim 7, wherein the transducer block comprises a seat for the transducer.

13. The transducer assembly of claim 12, wherein the transducer that the port is adapted to receive at least a portion of is a pressure transducer, and wherein:

the pressure transducer is positioned in the seat of the transducer block so that a first portion of the pressure transducer is inserted into the port of the transducer block;

the transducer flange is positioned to receive a second portion of the pressure transducer through the central orifice; and the transducer flange is bolted to the transducer block to form the seal between the transducer block and the transducer flange.

14. The transducer assembly of claim 7, wherein the port is perpendicular to the central channel.

15. The transducer assembly of claim 7, wherein the transducer assembly is adapted to be coupled to a blowout preventer.

16. A method of determining a condition during drilling of a well, the method comprising:

providing a transducer for taking a measurement of fluid from a well being drilled, wherein the transducer is coupled to a computer system;

providing a transducer assembly, wherein the transducer assembly comprises:

a transducer block, wherein the transducer block comprises:

a central channel extending from a first surface to a second surface and having an inlet and an outlet, wherein the inlet is adapted to receive at least a portion of the fluid from the well and the outlet is adapted to discharge the fluid from the central channel; and a port adapted to receive at least a portion of the transducer, wherein the port is in fluid communication with the central channel and comprises a channel extending from a top surface an to the central channel; and a transducer flange having a central orifice extending from a bottom side to a top surface, wherein the bottom side is affixed to the top surface of the transducer block, the central orifice is configured to align with the port of the transducer block to create a seal between the transducer block and the transducer flange, and a transducer seat is formed in the bottom side of the transducer flange;

wherein the transducer assembly is configured to take inline measurements of the fluid from the well; and receiving, by the computer system, a plurality of measurements from the transducer; and determining, by the computer system, responsive to the measurements, if a condition exist.

17. The method of claim 16, wherein the transducer is a pressure transducer and the plurality of measurements received by the computer system comprises a plurality of pressure measurements.

18. The method of claim 16, wherein providing the transducer assembly comprises providing the transducer assembly as part of a blowout preventer, wherein:

the blowout preventer comprises:

a body comprising a channel, wherein the channel is configured to receive fluid from the well; and one or more rams, wherein the one or more rams are configured to block fluid flow through the channel when in a first position and, wherein the one or more rams are configured to allow fluid flow through the channel when in a second position; and the transducer assembly receives at least a portion of the fluid from the well.

19. The method of claim 18, further comprising generating, by the computer system, an alert when one of the plurality of measurements is above a threshold.

20. The method of claim 19, further comprising:

determining, in response to the alert, a corrective action to be taken; and taking the corrective action.

21. The method of claim 20, wherein taking the corrective action comprises engaging the one or more rams of the blowout preventer to prevent fluid flow through the channel.

22. The method of claim 20, wherein taking the corrective action comprises modifying one or more drilling parameters of the well being drilled.

23. The method of claim 20, wherein the corrective action comprises at least one of:

increasing drilling mud pressure;

increasing density of the drilling mud;

reducing WOB of drill string used to drill the well;

reducing RPMs of the drill string;

reducing ROP of the drill string;

increasing measurement rate; and determining rate of change between consecutive measurements.

24. The method of claim 20, wherein the condition is predictive of an event.

25. The method of claim 24, wherein the event is a blowout.

26. The method of claim 20, wherein the condition is an influx of hydrocarbons into the well.

* * * * *